US007467743B1

(12) United States Patent
Philips

(10) Patent No.: US 7,467,743 B1
(45) Date of Patent: Dec. 23, 2008

(54) CONTAINER HAVING SELF-LOCKING STRUCTURE TO PROVIDE ADDED STABILITY

(75) Inventor: Nicholas A Philips, Sugar Grove, IL (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 11/954,914

(22) Filed: Dec. 12, 2007

(51) Int. Cl.
*B65D 5/30* (2006.01)

(52) U.S. Cl. ..... 229/169; 229/174; 229/178; 229/195; 229/196

(58) Field of Classification Search ..... 229/191, 229/195, 196, 169, 174, 178
See application file for complete search history.

(56) References Cited

U.S. PATENT DOCUMENTS 896,491 A * 8/1908 Wahl ..... 229/196
2,178,076 A * 10/1939 Kondolf ..... 229/195
2,237,927 A * 4/1941 Creek ..... 229/195
3,034,697 A * 5/1962 Frankenstein ..... 229/174
3,093,291 A * 6/1963 Brandle ..... 229/196
3,116,867 A * 1/1964 Morgan ..... 229/195
4,082,215 A * 4/1978 Eichenauer ..... 229/178
4,537,344 A * 8/1985 Thomas ..... 229/169
4,561,587 A * 12/1985 Wysocki ..... 229/169
4,702,409 A * 10/1987 Osborne ..... 229/174
4,883,221 A * 11/1989 Brundage ..... 229/174
5,016,814 A * 5/1991 Fullerton ..... 229/196
5,330,094 A * 7/1994 Mertz ..... 229/191
6,481,619 B1 * 11/2002 Jackson ..... 229/169

* cited by examiner

*Primary Examiner*—Gary E Elkins

(57) ABSTRACT

A tray-type container having a bottom panel is provided. The container has an outer side panel extending upwardly from the bottom panel. The outer side panel has a slit. An end panel is provided extending upwardly from said bottom panel to form, along with said side panel, an inner cavity. A flap extends from the end panel. The flap from the end panel is positioned within the slit of the outer side panel.

4 Claims, 12 Drawing Sheets

CONTAINER HAVING SELF-LOCKING STRUCTURE TO PROVIDE ADDED STABILITY

FIELD OF THE INVENTION

This invention relates generally to shipping and display type containers.

BACKGROUND OF THE INVENTION

Many heavy, dense flowable or shifting products exert tremendous inside-to-outward pressure as they slip, shift, slide or flow within a box or tray. Often these excessive containment demands require that portions of a box or tray have extra layers of corrugated walls and/or be further secured with reinforcing/fastening materials such as: tape, glue, hot-melt adhesive, corrugator-applied string filaments & tapes or metal stitches/staples. When stitches/staples are used, there is dramatic stacking strength loss due to crushing and damage to the fluting, in the most strength-sensitive areas of a box or tray. Accordingly, a need exists for container which provides durability.

BRIEF DESCRIPTION OF THE DRAWINGS

The preferred and alternative embodiments of the present invention are described in detail below with reference to the following drawings.

DETAILED DESCRIPTION OF THE INVENTION

The present invention provides a container or box having a structure and assembly sequence which can avoid the costs associated with enhancements and improve stacking strength. By "weaving" a perforated panel into a slot in a sidewall near each corner of the box, a self-locking structure is achieved which can survive such rigors. Furthermore, this structure, at the user's option, can have its "weaving panels" further formed manually, to create cells, gussets or corner-posts within the box or tray near the box's four main body corners.

The present invention includes a single sheet of foldable material cut and scored to form a blank formable into a container. By way of overview and with reference to FIGS. 1-18, an embodiment of the present invention includes a single piece blank 2 arranged to form a stackable container 100. Specific details of the blank 2 and container 100 are described with more particularity below.

The present invention will now be described with reference to the accompanying FIGS. 1-18 where like numerals correspond to like elements. In all FIGURES, cut lines are shown as solid lines, score lines or lines of weakness are shown as broken lines. The present invention is directed to a tray-type container that utilizes a corner assembly to create a modular stackable container. The container includes an arrangement of panels, which are adapted to provide suitable container stability.

For the purpose of further description herein, the downward direction is defined as the direction perpendicular to bottom panel 4 that corresponds to the outer surface of the bottom panel when the container has been erected, and the upward direction is defined as the direction perpendicular to the bottom panel that corresponds to the inner surface of the bottom panel when the container has been erected.

Figure 1:
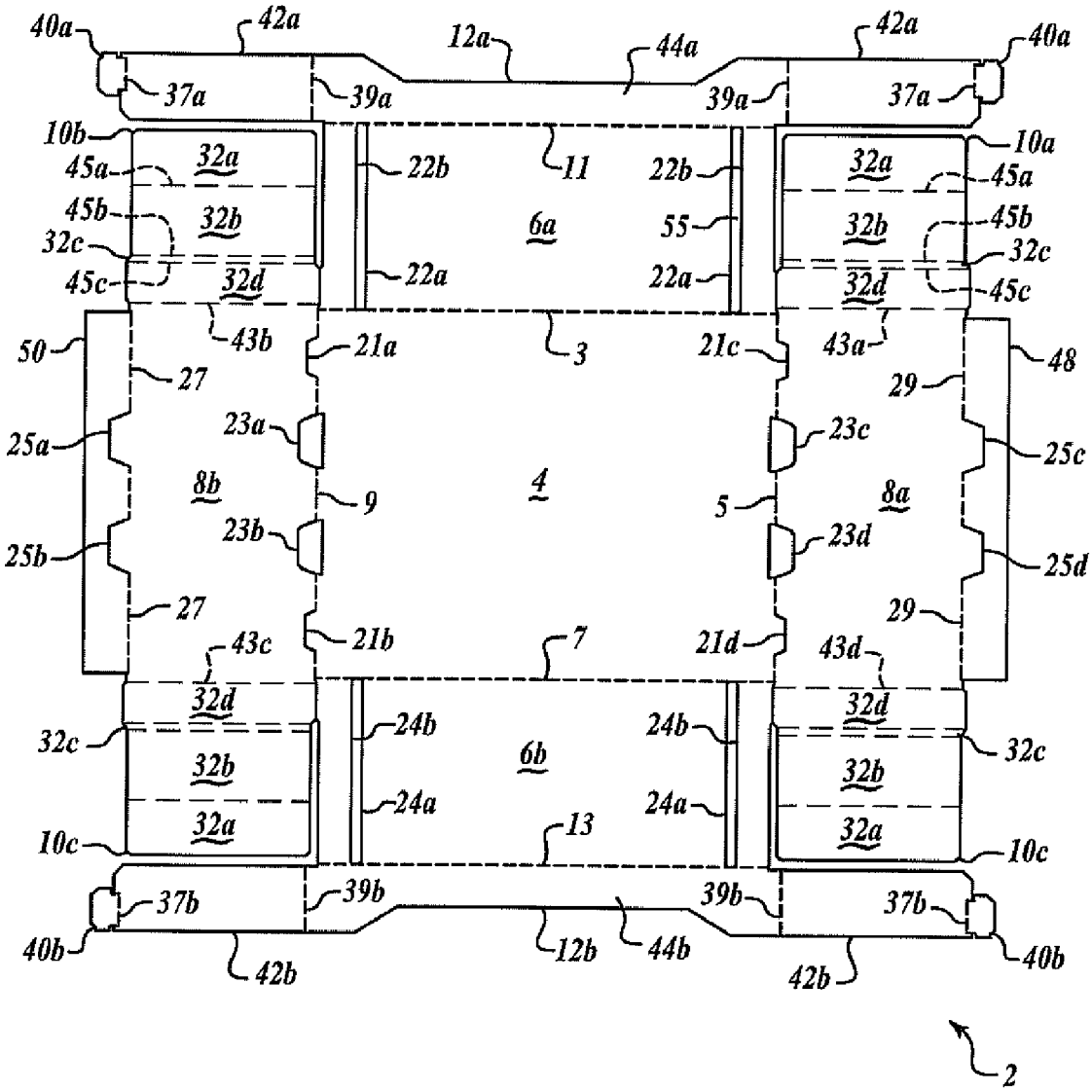
FIG. 1 is a perspective view of a container as a flat blank.
Figure 9:
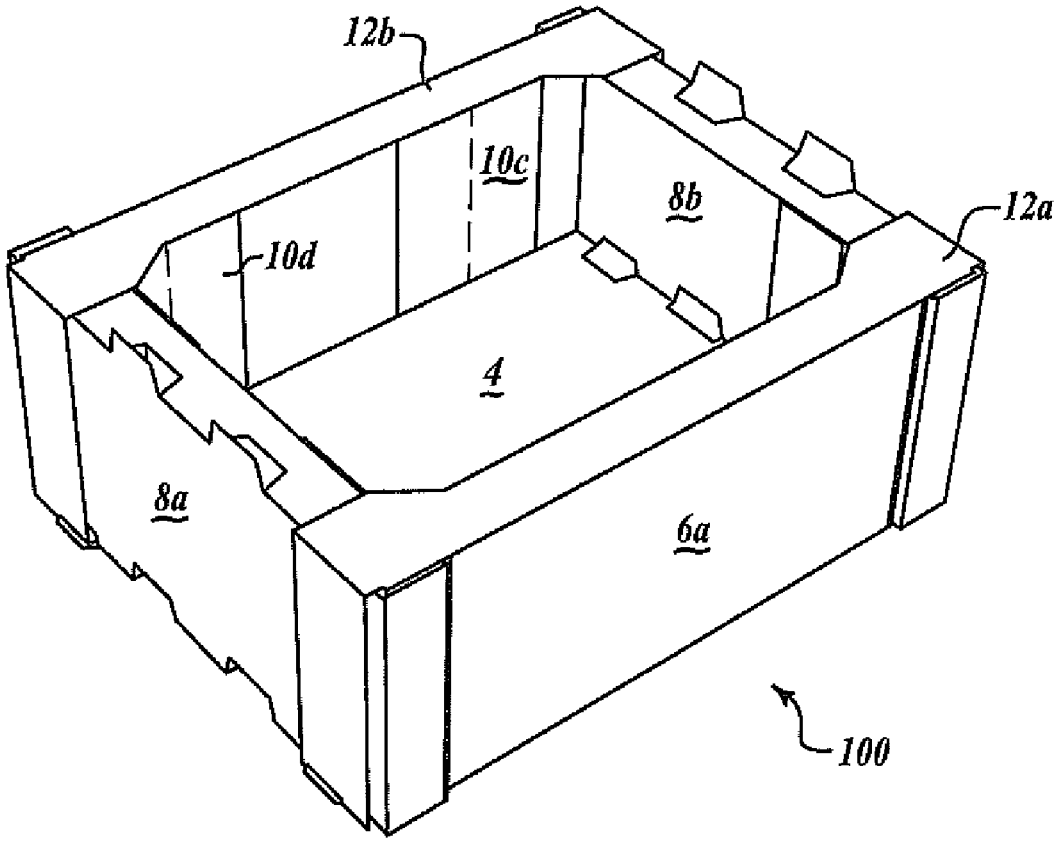
FIG. 9 is a perspective view of a container made from the blank of FIG. 1.
Figure 10:
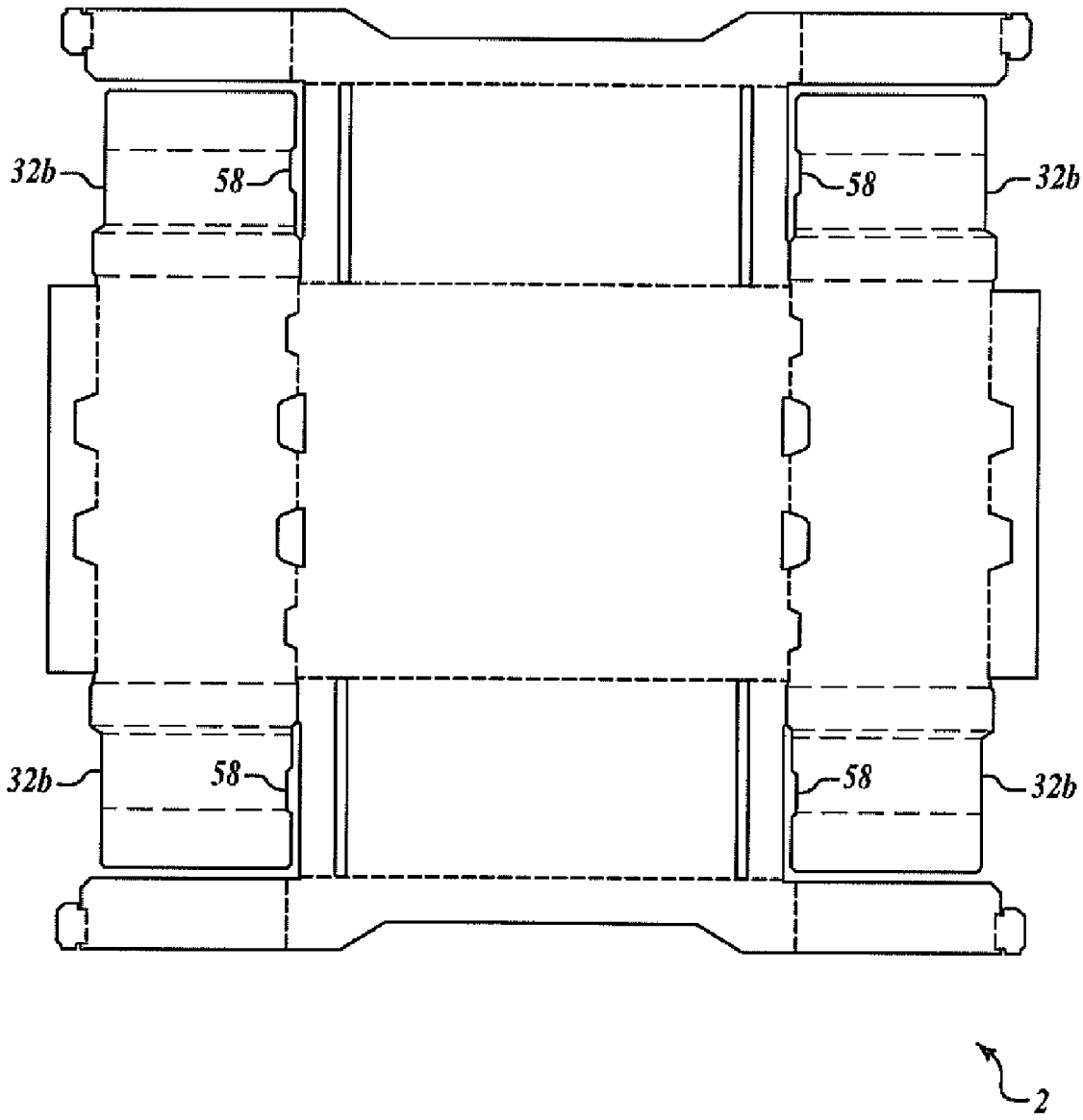
FIG. 10 is a perspective view of a container as a flat blank.
Figure 11:
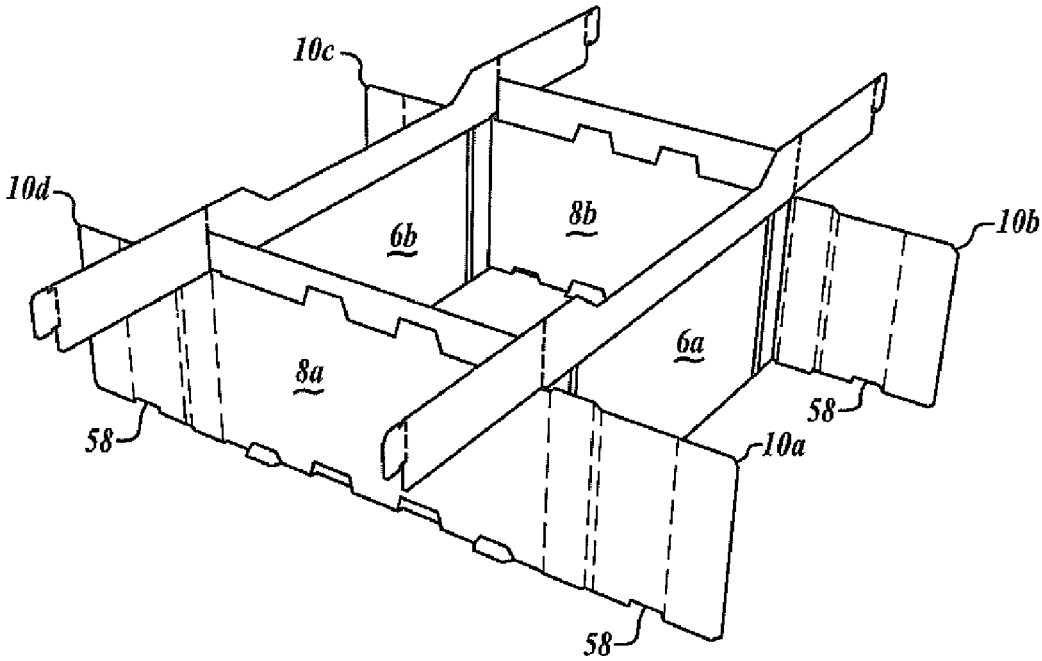
FIG. 11 is a perspective view of a partially erected container formed from the blank of FIG. 10.
Figure 12:
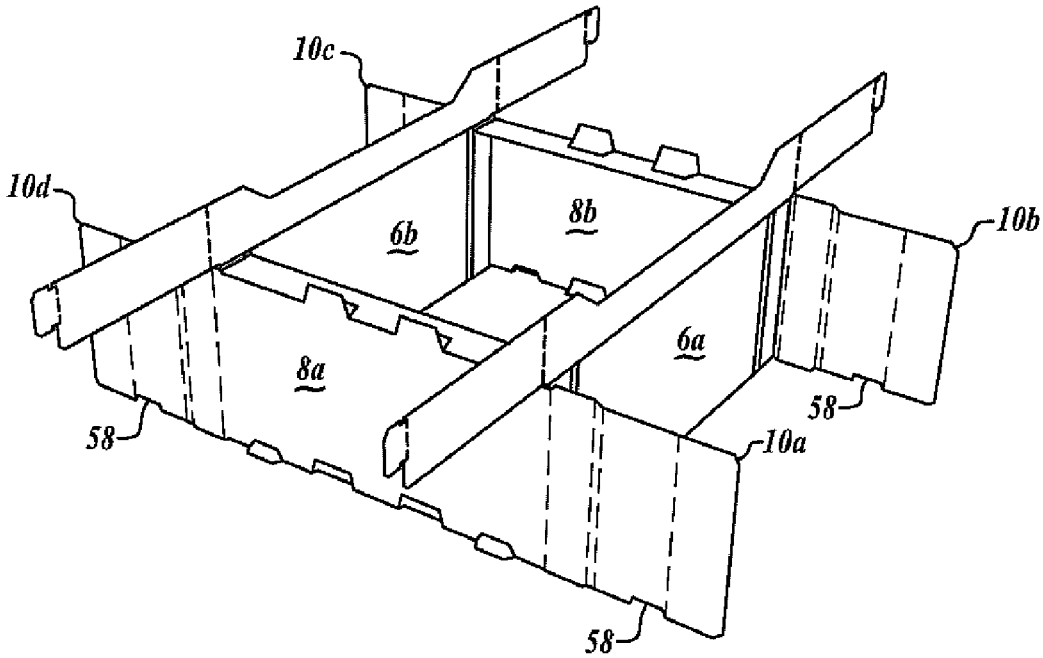
FIG. 12 is another perspective view of a partially erected container formed from the blank of FIG. 10.
Figure 13:
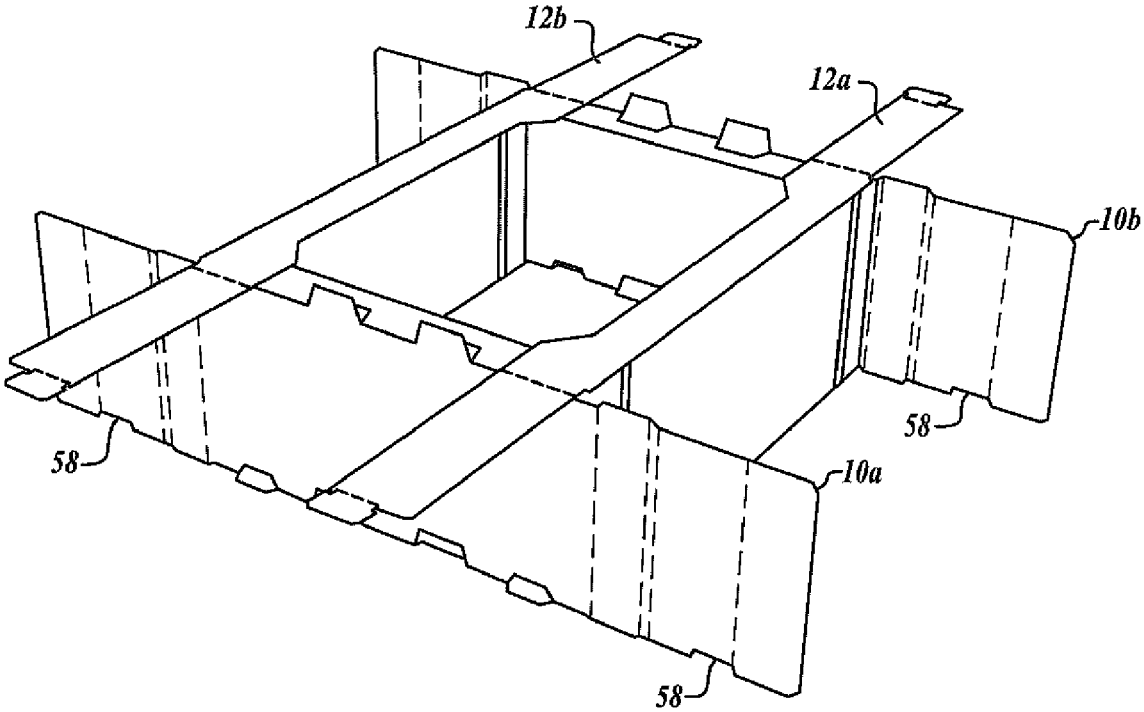
FIG. 13 is yet another perspective view of a partially erected container formed from the blank of FIG. 10.
Figure 14:
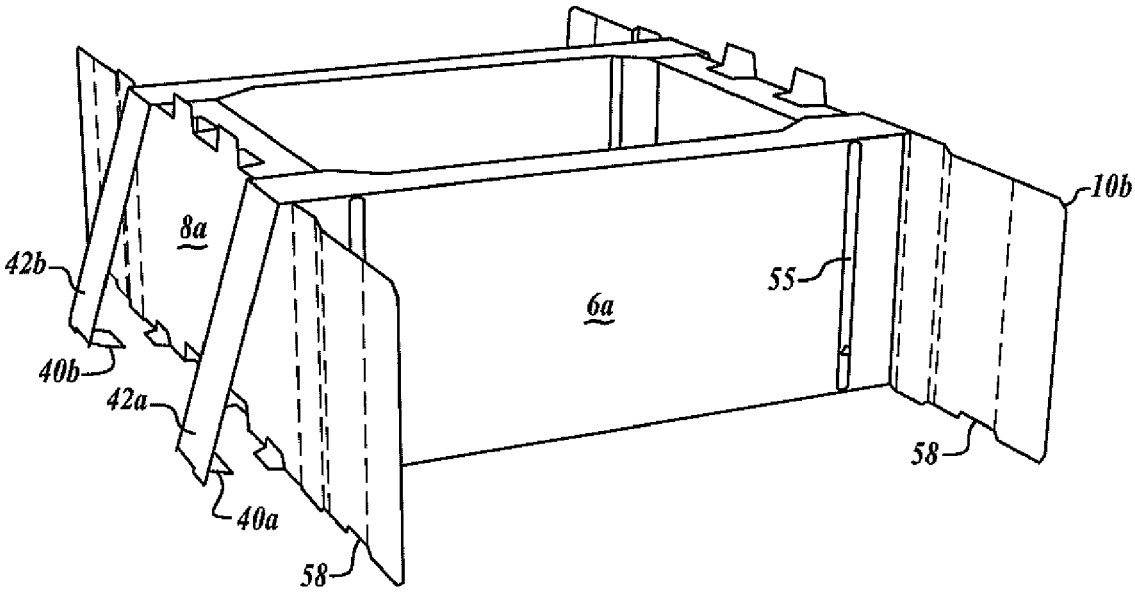
FIG. 14 is yet another perspective view of a partially erected container formed from the blank of FIG. 10.
Figure 15:
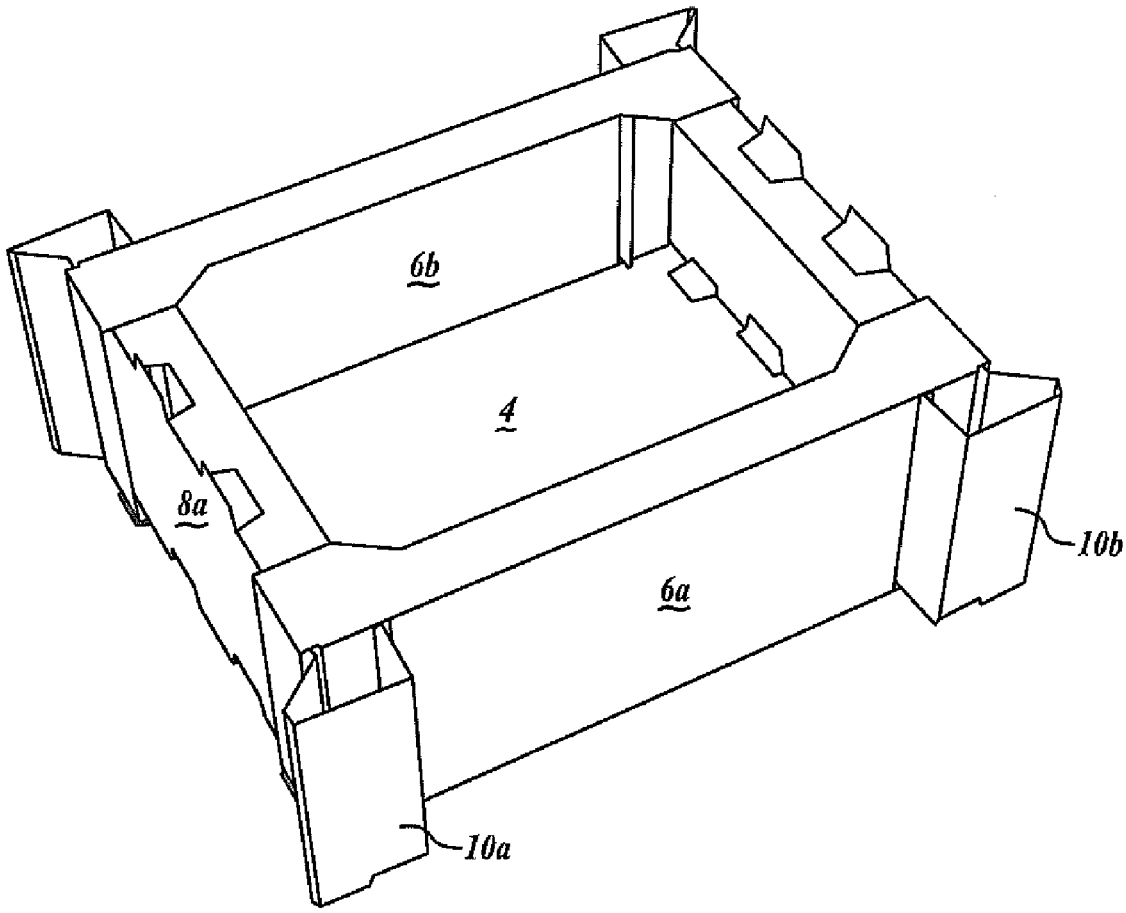
FIG. 15 is yet another perspective view of a partially erected container formed from the blank of FIG. 10.

The blank 2 and resulting container 100 is typically made from any suitable material used in the shipping, storing or displaying of goods. Suitable, nonlimiting examples of such materials include paperboard, containerboard, cardboard, pasteboard, fiberboard, corrugated containerboard, corrugated paperboard, single wall corrugated containerboard, multiwall corrugated containerboard or a combination thereof. As best shown in FIGS. 1 and 10, a blank 2 is stamped out of any of these suitable materials and assembled in a manner which can be seen in FIGS. 1-10.

FIG. 1 illustrates a flat blank 2 having a center or bottom panel 4. First side panel 8*a* is opposite the center panel 4 along fold line 5. First side panel 8*b* is opposite the center panel 4 along fold line 9. Second side, or end, panel 6*a* is opposite center panel 4 along fold line 3. Second side, or end, panel 6*b* is opposite center panel 4 along fold line 7.

Cut lines 21*c*, 21*d* are adjacent fold line 5. Located between cut lines 21*c*, 21*d*, and along fold line 5, are cut lines 23*c*, 23*d* which may be, for example, trapezoidal in shape. However, any shape is contemplated which is known to those skilled in the art. Cut lines 21*a*, 21*b* are adjacent fold line 9. Located between cut lines 21*a*, 21*b*, and along fold line 9, are cut lines 23*a*, 23*b* which may also be, for example, trapezoidal in shape. Again, any shape is contemplated which is known to those skilled in the art.

Side panel 8*a* may have fold line 29. Located along the fold line 29 are cut lines 25*c*, 25*d*. Flap 48 is provided opposite side panel 8*a* along fold line 29. Side panel 8*b* may have fold line 27. Located along the fold line 27 are cut lines 25*a*, 25*b*. Flap 50 is provided opposite side panel 8*b* along fold line 27.

Side panel 6*a* may have fold line 11 and may further have cut lines 22*a*, 22*b* which are adjacent to each other and separated by a space which may have dimensions contemplated by those skilled in the art. Opposite the side panel 6*a* along the fold line 11 is flap 12*a* which is divided into sections 40*a*, 42*a*, 44*a*. Sections 42*a* are opposite section 44*a* along fold lines 39*a*. Sections 40*a* are opposite sections 42*a* along fold lines 37*a*.

Side panel 6*b* may have fold line 13 and may further have cut lines 24*a*, 24*b* which are adjacent to each other and separated by a space which may have dimensions contemplated by those skilled in the art. Opposite the side panel 6*b* along the fold line 13 is flap 12*b* which is divided into sections 40*b*, 42*b*, 44*b*. Sections 42*b* are opposite section 44*b* along fold line 39*b*. Sections 40*b* are opposite sections 42*b* opposite fold line 37*b*.

Flap 10*a* is provided opposite side panel 8*a* along fold line 43*a*. Flap 10*b* is provided opposite side panel 8*b* along fold line 43*b*. Flap 10*c* is provided opposite side panel 8*b* along fold line 43*c*. Flap 10*d* is provided opposite side panel 8*a* along fold line 43*d*. Flaps 10*a*, 10*b*, 10*c*, 10*d* are divided into sections 32*a*, 32*b*, 32*c*, 32*d* by fold lines 45*a*, 45*b*, 45*c*.

Figure 2:
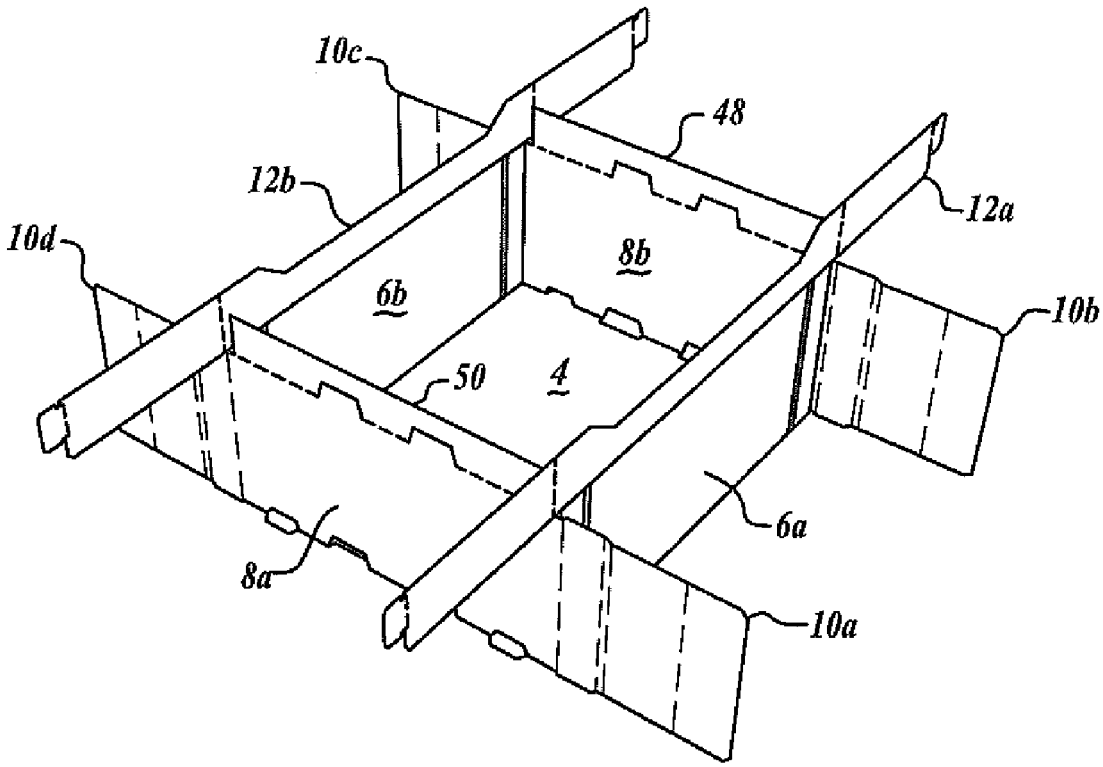
FIG. 2 is a perspective view of a partially erected container formed from the blank of FIG. 1.
Figure 3:
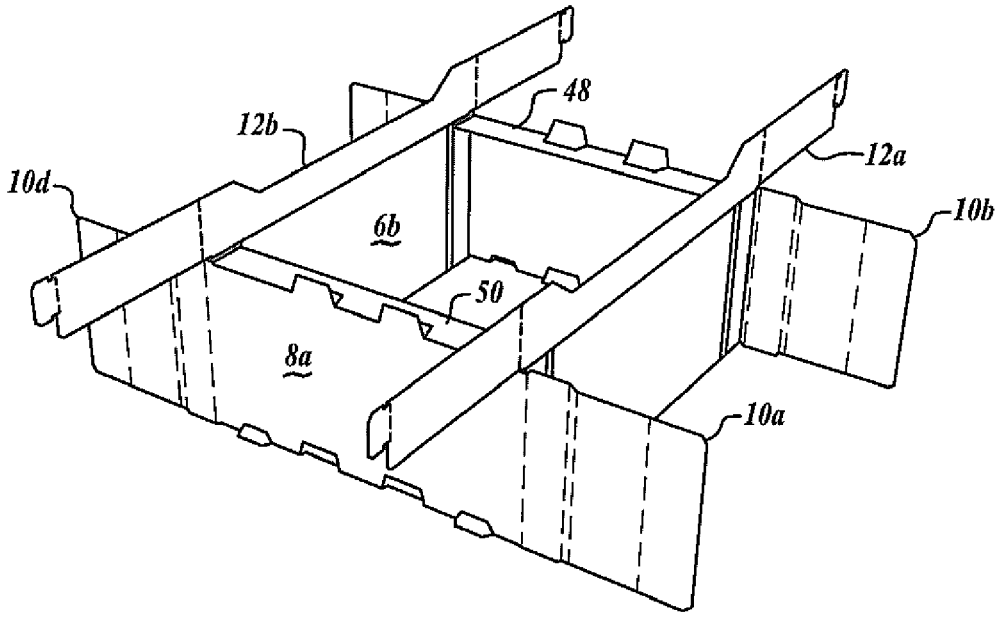
FIG. 3 is another perspective view of a partially erected container formed from the blank of FIG. 1.
Figure 4:
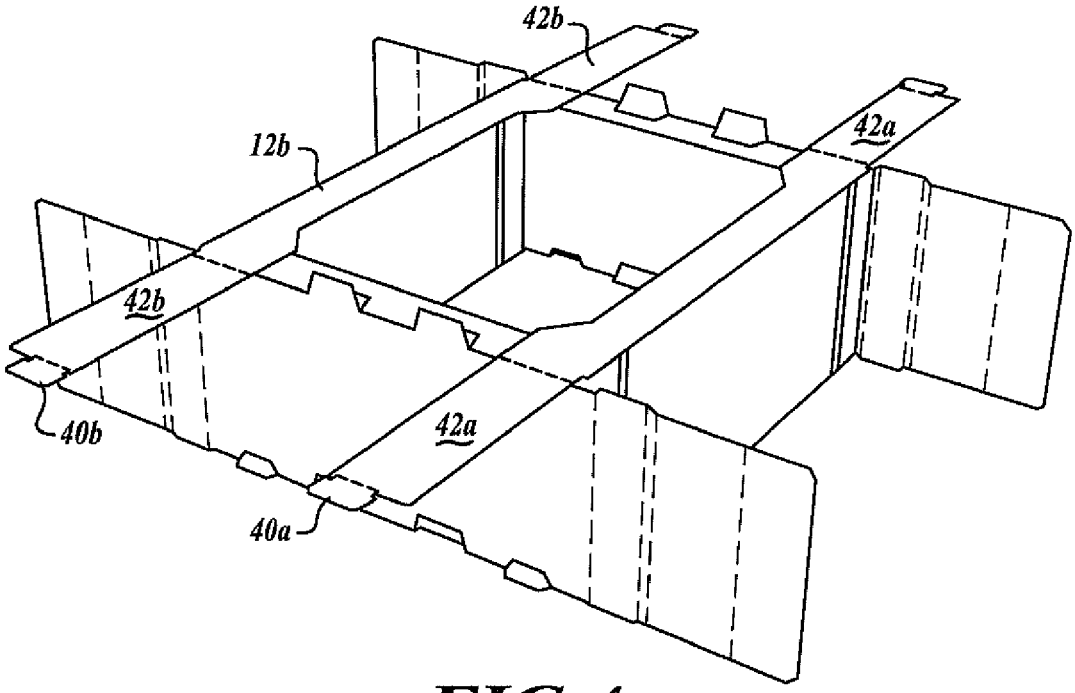
FIG. 4 is yet another perspective view of a partially erected container formed from the blank of FIG. 1.
Figure 5:
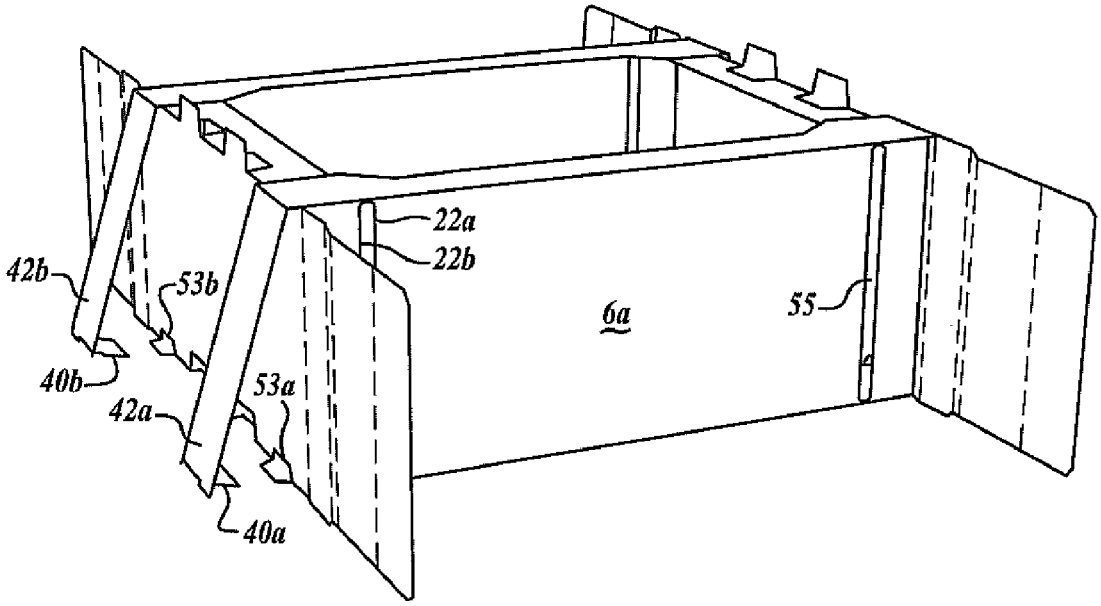
FIG. 5 is yet another perspective view of a partially erected container formed from the blank of FIG. 1.
Figure 6:
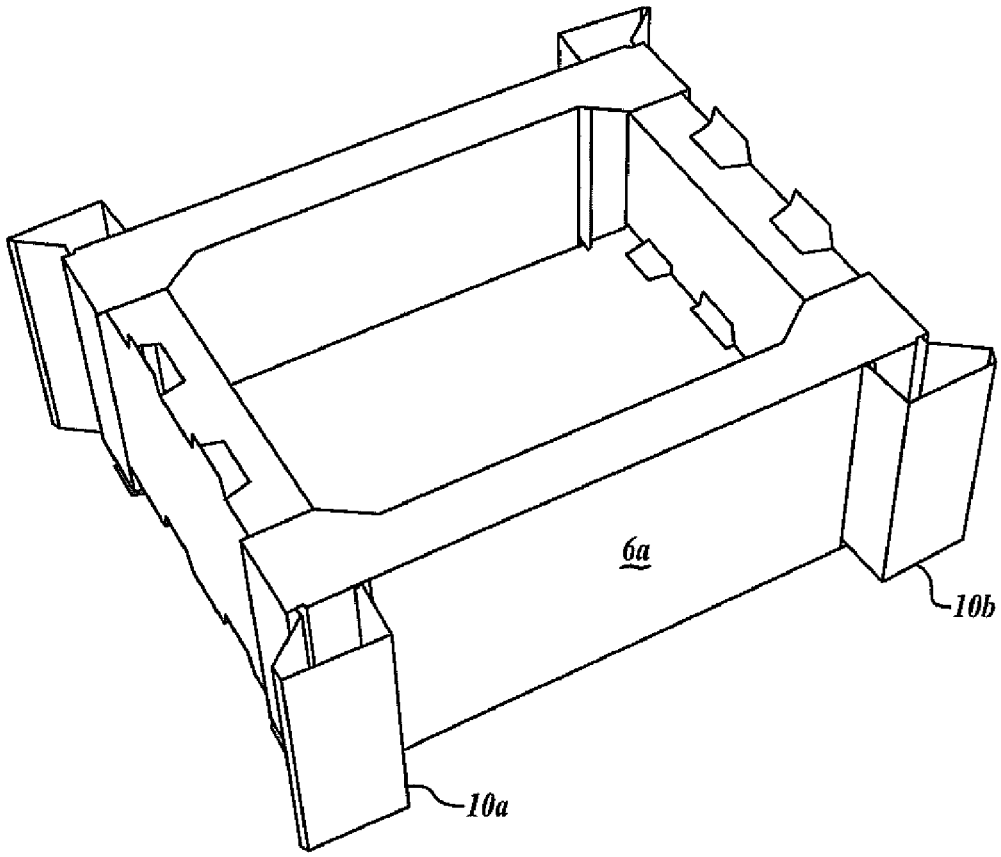
FIG. 6 is yet another perspective view of a partially erected container formed from the blank of FIG. 1.
Figure 7:
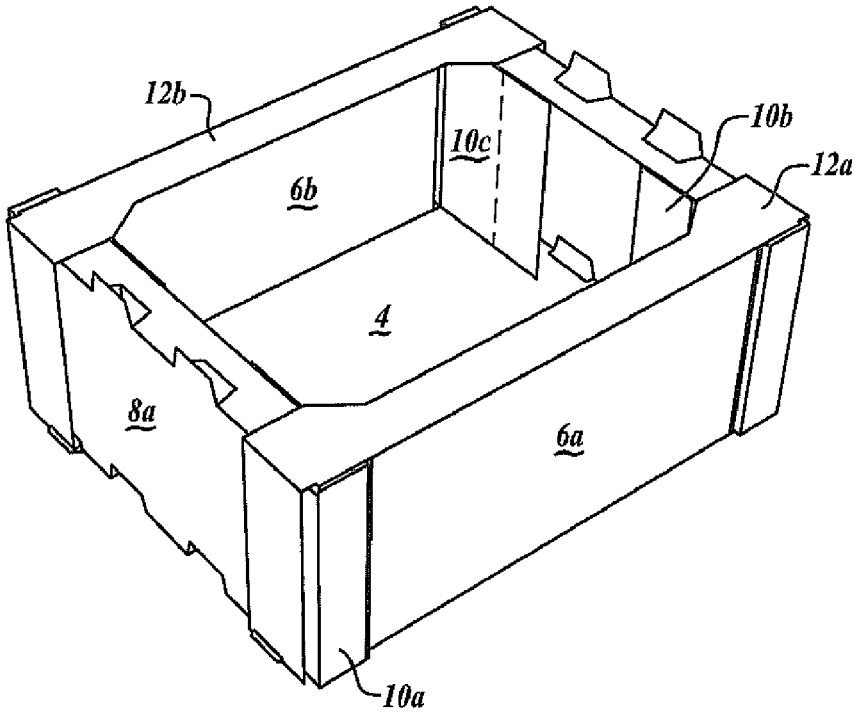
FIG. 7 is yet another perspective view of a partially erected container formed from the blank of FIG. 1.
Figure 8:
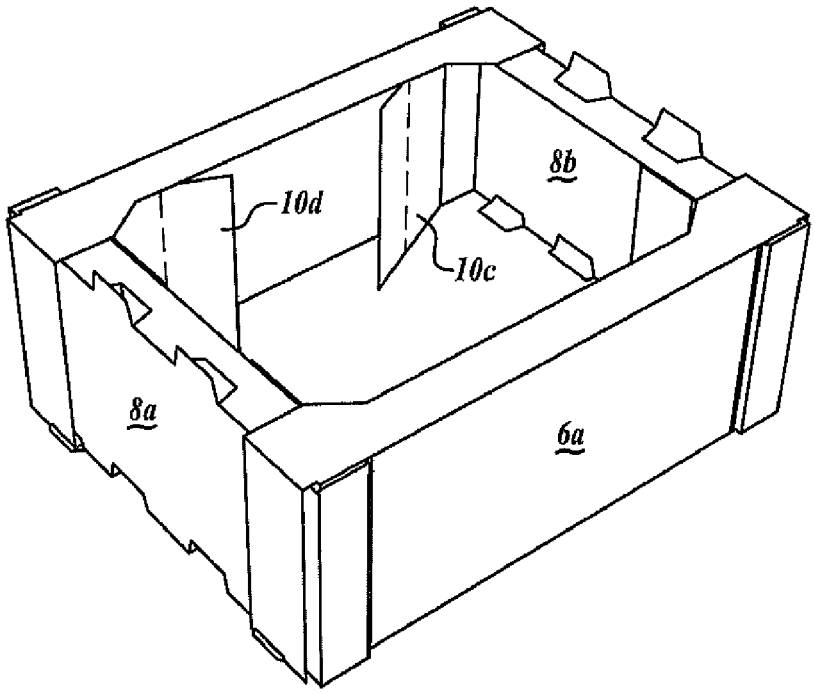
FIG. 8 is yet another perspective view of a partially erected container formed from the blank of FIG. 1.

Referring now to FIG. 2, one method of constructing the container 100 from the blank 2 will be described. In a first step, the side panels 6*a*, 6*b*, 8*a*, 8*b* are folded up. More specifically, side panel 6*a* is folded about fold line 3; side panel 6*b* is folded about fold line 7; side panel 8*a* is folded about fold line 5; and side panel 8*b* is folded about fold line 9. In a next step, shown in FIG. 3, flap 48 is folded about fold line 29. Flap 50 is folded about fold line 27. Next, as shown in FIG. 4, flap 12*a* is folded about fold line 11. Flap 12*b* is folded about fold line 13. Next, as shown in FIG. 5, flap 42*a* is folded downward about fold line 39*a* and flap 42*b* is folded downward about fold line 39*b*. Flap 40*a* is folded toward the center panel 4 about fold line 37*a*. Flap 40*b* is folded toward the center panel 4 about the fold line 37*b*. Flaps 40*a*, 40*b* are placed into slits 53*a*, 53*b*, respectively, as created by cut lines 21*c*, 21*d*, respectively. In symmetric fashion, flaps 42*a*, 42*b*, 40*a*, 40*b* may be folded and placed into slits (not shown) within side panel 8*b*. Next, as shown in FIG. 6, flap 10*a* is folded at fold lines 45*a*, 45*b*, 45*c* and 43*a* and inserted into a slit 55 created by cut lines 22*a*, 22*b*. The remaining flaps 10*b*, 10*c*, 10*d* are also folded and placed into slits created by the corresponding symmetric cut lines. The flaps 10*a*, 10*b*, 10*c*, 10*d* are pushed through the slits completely such that sections 32*d* are flush with side panels 6*a* or 6*b*. Flaps 10*a*, 10*b*, 10*c*, 10*d* may be folded at fold line 45*b* such that sections 32*a* and 32*b* are placed flush against inner surfaces of side panels 6*a* or 6*b*, as shown in FIG. 9.

Figure 16:
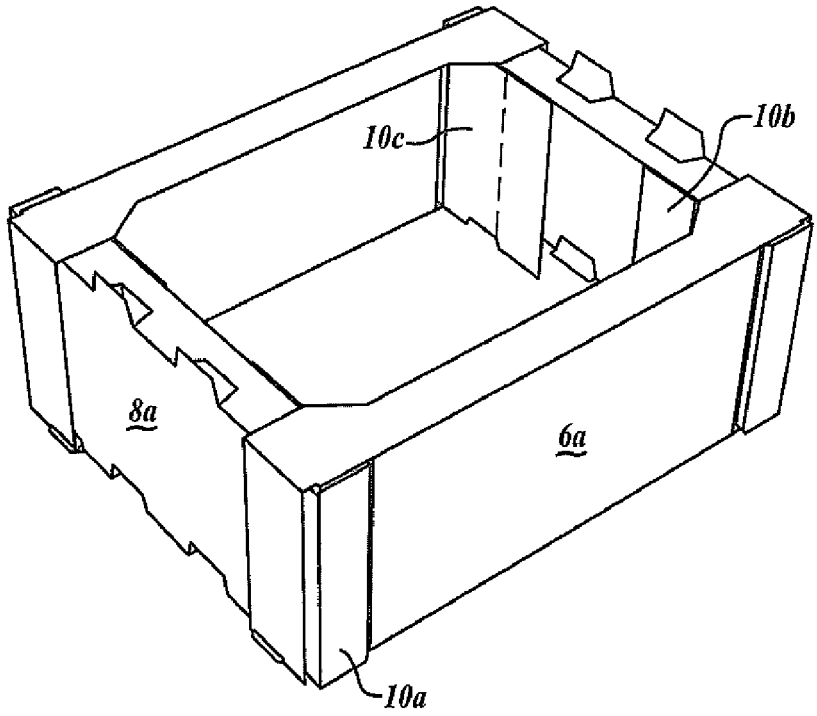
FIG. 16 is yet another perspective view of a partially erected container formed from the blank of FIG. 10.
Figure 17:
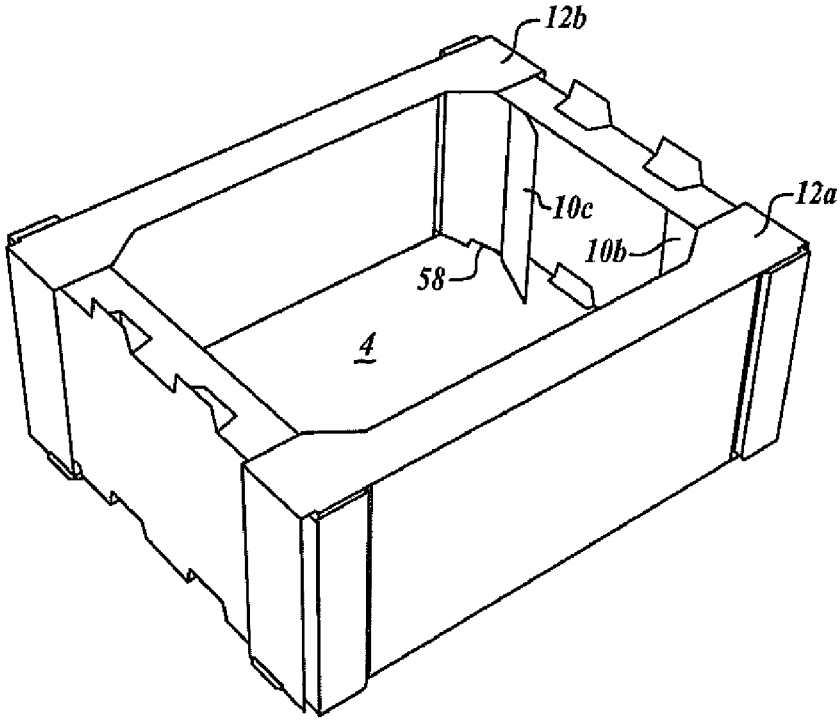
FIG. 17 is yet another perspective view of a partially erected container formed from the blank of FIG. 10.
Figure 18:
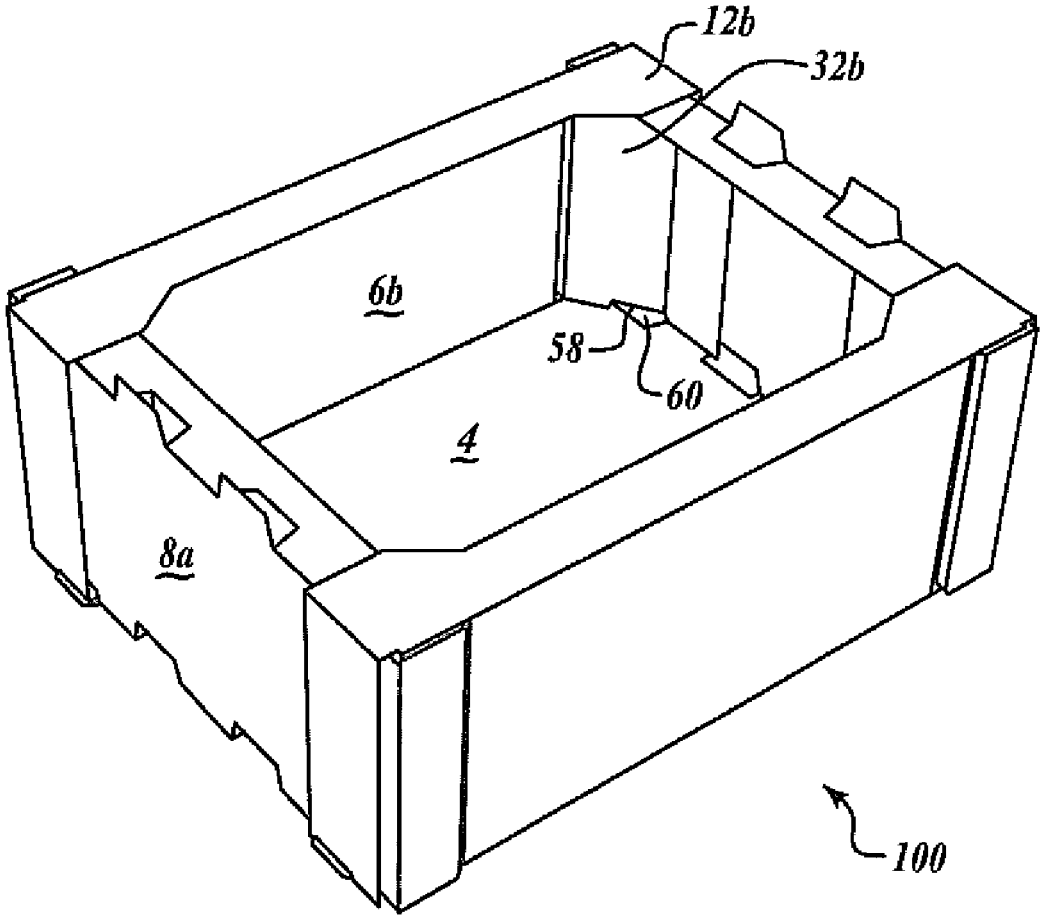
FIG. 18 is a perspective view of a container made from the blank of FIG. 10.

In an alternate embodiment, shown in FIG. 10, the blank 2 is substantially similar in shape to the embodiment described above. However, in this embodiment, the section 32*b* has a ridge 58 formed on a side adjacent to side panel 6*a* or 6*b*. FIGS. 11-15 depict similar method steps for assembling the container 100 as seen in FIGS. 2-7. However, once the flaps 10*a*, 10*b*, 10*c*, 10*d* are placed through the slit 55, the flaps 10*a*, 10*b*, 10*c*, 10*d* are positioned toward the side panels 8*a* or 8*b*, as shown in FIGS. 16 and 17. Moreover, as seen in FIG. 18, the ridge 58 is positioned such that it is aligned or partially aligned with an opening 60 formed by cut line 21*b*. Section 32*b* of the flap 10*c* may be positioned in a diagonal arrangement to provide a gusset-type structure. As previously mentioned, similar symmetrical method steps are carried forward at other areas of the blank 2 to completely assemble the container 100.

The flaps 10*a*, 10*b*, 10*c*, 10*d* which are tucked into the container 100 have additional and special fold lines in them, which allow them ultimately to be tucked in, and then achieve an "S" configuration or a "triangular gusset" configuration, at the user's option. Flaps 12*a*, 12*b* attached to the side panel 6*a*, 6*b* which incorporate the locking slit 55 which, in effect, keeps the upper edge of the tuck panel 6*a*, 6*b* from moving upward or tearing upward, within the slit or slot 55, which could disengage or compromise the locking feature. Beyond the box's main blank 2, no additional fastening materials, devices or adhesives, of any kind, are needed to erect and lock the container 100 while achieving excellent containment properties.

In use, container 100 may be filled with product (not shown) and stacked with one or more other containers 100 on a pallet (not shown) or display shelf (not shown). In one possible application, a selected number of containers 100 filled with product (not shown) are stacked on pallet (not shown), and pallet (not shown) may be moved from receiving directly to the display floor of the retailer (perhaps after removing an external common cover, strapping or wrap), where end-user purchasers have access to the pallet of containers. The individual containers 100 may not include covers, tops or lids of corrugated material, instead being arranged such that the upper containers engage over and cover the next lower one. The containers 100 are accessed on the display floor and generate less waste. Purchasers may select product (not shown) from one of the open containers 100, generally from those containers at the top of the stack. The increased strength of the containers allows the containers to better resist vertical collapse or lateral deflection caused by the forces of handling and the like. Handholds (not shown) allow containers to be easily manipulated by stock personnel or others, individually or in stacks of two or more.

As another alternative, the container of the invention may also include a top or other means to cover the container. In addition to the advantages apparent from the foregoing description, the present invention improves the container's strength, especially crushed in the vertical direction. A related advantage is that the contents of such containers are less likely to be damaged.

While an embodiment of the invention has been illustrated and described, as noted above, many changes can be made without departing from the spirit and scope of the invention. For example, the blank may also include other features specified by the customer, such as hand holds, vent holes, grease or moisture barriers and the like without exceeding the scope of the present invention. Accordingly, the scope of the invention is not limited by the disclosure of the preferred embodiment. Instead, the invention should be determined entirely by reference to the claims that follow.

What is claimed is:

1. A blank for a container comprising:

a single sheet of foldable material cut and scored to define a bottom panel, said bottom panel having a side edge and an end edge;

a side panel hingedly attached to said bottom panel along said side edge, said side panel having a slit formed within a body of the panel, the side panel having a top edge opposite the attachment of the side panel to the bottom panel, and a side edge extending between the side panel attachment to the bottom panel and the side panel top edge;

an end panel hingedly attached to said bottom panel along said end edge, the end panel having a first flap extending therefrom, the first flap having a plurality of fold lines; wherein said slit is sized to receive said first flap and wherein after positioning said first flap through said slit the first flap may be folded at one or more of the plurality of fold lines and positioned adjacent to either the side panel or the end panel;

a second flap attached to the side panel along the top edge thereof, the second flap being divided by fold lines into a first section attached to the side panel, a second section attached to the first section and extending beyond the side edge of the side panel and having an outer end opposite the attachment of the second section to the first section, and a third section attached to the second section at its outer end, and an opening in the end panel positioned and sized to receive the third section when the container is erected.

2. The blank of claim 1 wherein the blank is formed from at least one of a paperboard, containerboard, cardboard, pasteboard, fiberboard, corrugated containerboard, corrugated paperboard, single wall corrugated containerboard, and multiwall corrugated containerboard.

3. A container comprising:

a bottom panel, an outer side panel extending upwardly from said bottom panel wherein the outer side panel has a slit;

an end panel extending upwardly from said bottom panel to form, along with said side panel, an inner cavity an opening in the end panel, the end panel having an outer face;

a first flap extending from the end panel, the first flap having a plurality of fold lines; wherein the first flap is positioned within the slit of the outer side panel and wherein the first flap may be folded at one or more of the plurality of fold lines and positioned adjacent to either the side panel or the end panel, a second flap attached to the side panel along the top edge thereof, the second flap being divided by fold lines into a first section attached to the side panel, a second section attached to the first section and extending down the outer face of the end panel, and a third section attached to the second section and extending through the end panel opening.

4. The container of claim 3 wherein the container is formed from at least one of a paperboard, containerboard, cardboard, pasteboard, fiberboard, corrugated containerboard, corrugated paperboard, single wall corrugated containerboard, and multiwall corrugated containerboard.

* * * * *